United States Patent [19]

Rohner

[11] Patent Number: 4,518,136

[45] Date of Patent: May 21, 1985

[54] DEVICE FOR COLLECTING SPOOLS

[75] Inventor: Joachim Rohner, Monchen-Gladbach, Fed. Rep. of Germany

[73] Assignee: W. Schlafhorst & Co., Monchen-Gladbach, Fed. Rep. of Germany

[21] Appl. No.: 507,802

[22] Filed: Jun. 24, 1983

[30] Foreign Application Priority Data

Jun. 24, 1982 [DE] Fed. Rep. of Germany ..... 3223593

[51] Int. Cl.[3] ..... B65H 54/20; B65H 67/06

[52] U.S. Cl. ..... 242/35.5 A; 198/339

[58] Field of Search ..... 242/35.5 A, 35.5 R, 242/35.6 R, 32; 57/274, 276, 281; 198/339, 367, 370, 448, 607

[56] References Cited

U.S. PATENT DOCUMENTS

| | | | |
|---|---|---|---|
| 1,130,877 | 3/1915 | Bernheim | 198/367 |
| 1,822,111 | 9/1931 | Richardson et al. | 198/339 |
| 2,769,598 | 11/1956 | Drake et al. | 242/35.5 A |
| 3,195,298 | 7/1965 | Furst | 242/35.5 R X |
| 3,548,895 | 12/1970 | Gentry, Jr. | 198/370 X |
| 3,998,397 | 12/1976 | Haberkorn et al. | 242/35.5 A |
| 4,173,274 | 11/1979 | Kantarian | 198/367 |

FOREIGN PATENT DOCUMENTS

| | | | |
|---|---|---|---|
| 2509871 | 9/1975 | Fed. Rep. of Germany A | 242/35.5 |
| 616114 | 1/1961 | Italy | 242/35.5 A |
| 26580 | 9/1970 | Japan | 242/35.5 A |

*Primary Examiner*—Stanley N. Gilreath

*Attorney, Agent, or Firm*—Herbert L. Lerner; Laurence A. Greenberg

[57] ABSTRACT

A device for collecting ejected wound, partially wound, or empty spools at the working stations of an automatic spool winding machine, includes a device guided along the working stations for horizontally transporting the spools; at least two laterally spaced apart mounting devices disposed in vicinity of the transporting device; at least one spool removal device mounted to one of the mounting devices, the spool removal device including a spool diverting device downstream of the transporting device for receiving the spools, a spool lifting device for lifting the spools from the diverting device, and a spool collecting container for receiving the spools from the lifting device; and a device for transmitting force from the transporting device for driving the spool lifting device.

6 Claims, 6 Drawing Figures

FIG. 3
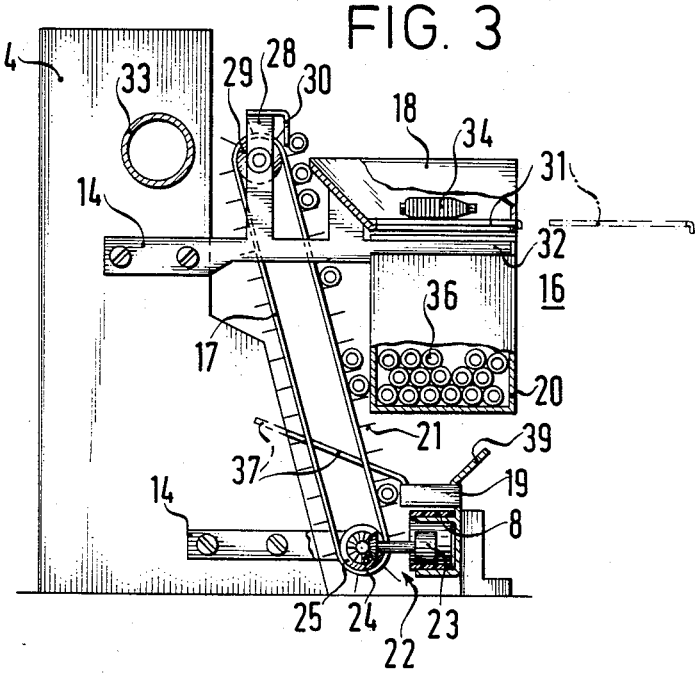
FIG. 6
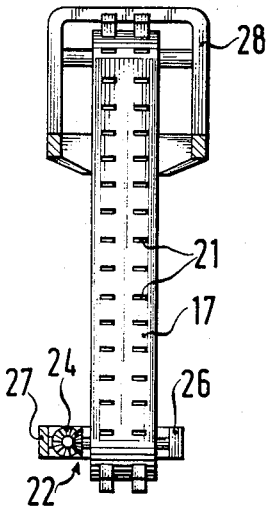
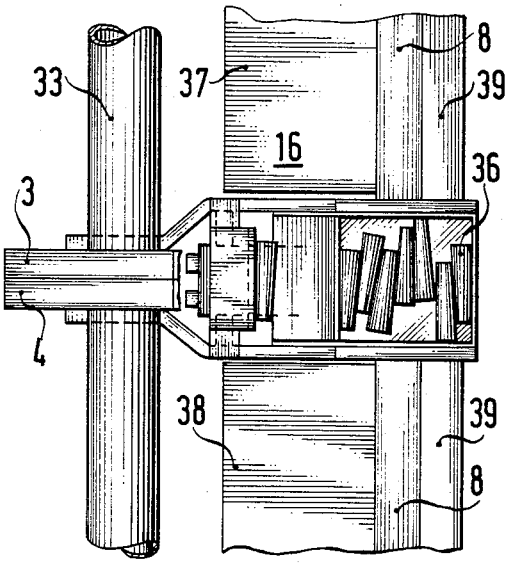
FIG. 4
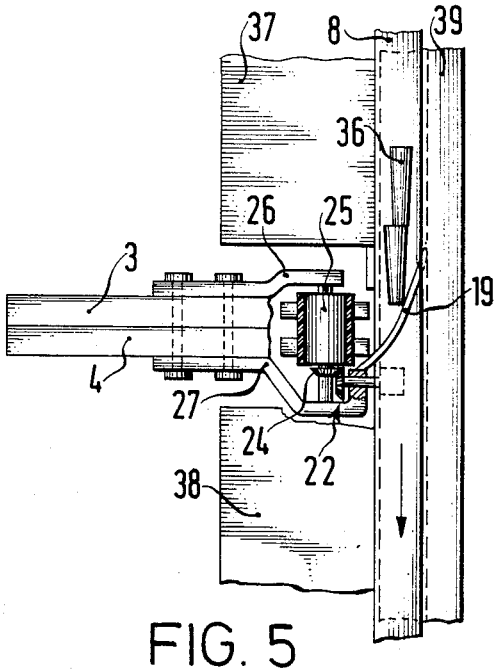
FIG. 5

DEVICE FOR COLLECTING SPOOLS

The invention relates to a device for collecting wound, partially wound, or empty spools at the working stations of an automatic spool winding machine.

It is known to eject wound, partially wound or empty spools produced at the working station of an automatic spool winding machine onto a conveyor belt, at the end of which a collection unit is disposed.

If a spool winding machine is formed of a plurality or a multiplicity of work stations, a certain number of work stations are combined into a section, and it becomes possible to wind a different batch of yarn in each section. In this case, it is a disadvantage if the spools of different batches arrive at a common collection point. To avoid this, a separate transportation belt for each batch would have to be provided. This is a very costly measure, and would require a high installation cost, when changing a batch to a greater or smaller number of sections.

It is accordingly an object of the invention to provide a device for collecting spools, which overcomes the hereinafore-mentioned disadvantages of the heretofore-known devices of this general type and to collect the ejected spools separately in a simple manner at a spool winding machine, in which either one uniform batch of yarn or sections of chosen sizes can be wound with different batches of yarn, as desired. When changing the size of the batches, a corresponding adjustment of the collection device should be possible with few manual operations.

With the foregoing and other objects in view there is provided, in accordance with the invention, a device for collecting ejected wound, partially wound, or empty spools or spool formers at the working stations of an automatic spool winding machine, comprising a single device guided along all of the working stations for horizontally transporting the spools; at least two laterally spaced apart mounting locations or devices disposed in vicinity of the transporting device; at least one spool removal device mounted to one of the mounting devices, the spool removal device including a spool diverting device downstream of the transport device for receiving the spools, a spool lifting device for lifting the spools from the diverting device, and a spool collecting container for receiving the spools from the lifting device; and means for transmitting force from the transporting device for driving the spool lifting device.

In accordance with another feature of the invention, the transporting device is in the form of an endless conveyor belt, and the spool diverting device includes a deflector disposed above the conveyor belt.

In accordance with further feature of the invention, the spool lifting device is an elevator.

In accordance with a concomitant feature of the invention, the force transmitting means includes a friction wheel engageable with the transporting device, a drive connected to the friction wheel, and a drive element connected to the drive and to the elevator. The advantages achieved by practicing the invention are especially the basic provision that only one horizonal transportation device need be provided and guided along the working stations.

In this way, a desired number of spool removal devices can be brought in connection with the horizontal transportation device like building blocks, where one batch ends and the other batch begins. The wound, partially wound or empty spools of the individual batches can no longer be intermixed, in spite of the fact that there is only a single horizontal transportation device.

Other features which are considered as characteristic for the invention are set forth in the appended claims.

Although the invention is illustrated and described herein as embodied in a device for collecting spools, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a partly cross-sectional and partly broken-away side elevational view of a spool removal device;

FIG. 4 is a fragmentary top plan view of the spool removal device;

FIG. 5 is another fragmentary top plan view, being partly broken away to show details of the spool removal device; and FIG. 6 is a front elevational view of the spool removal device.

Figure 1:
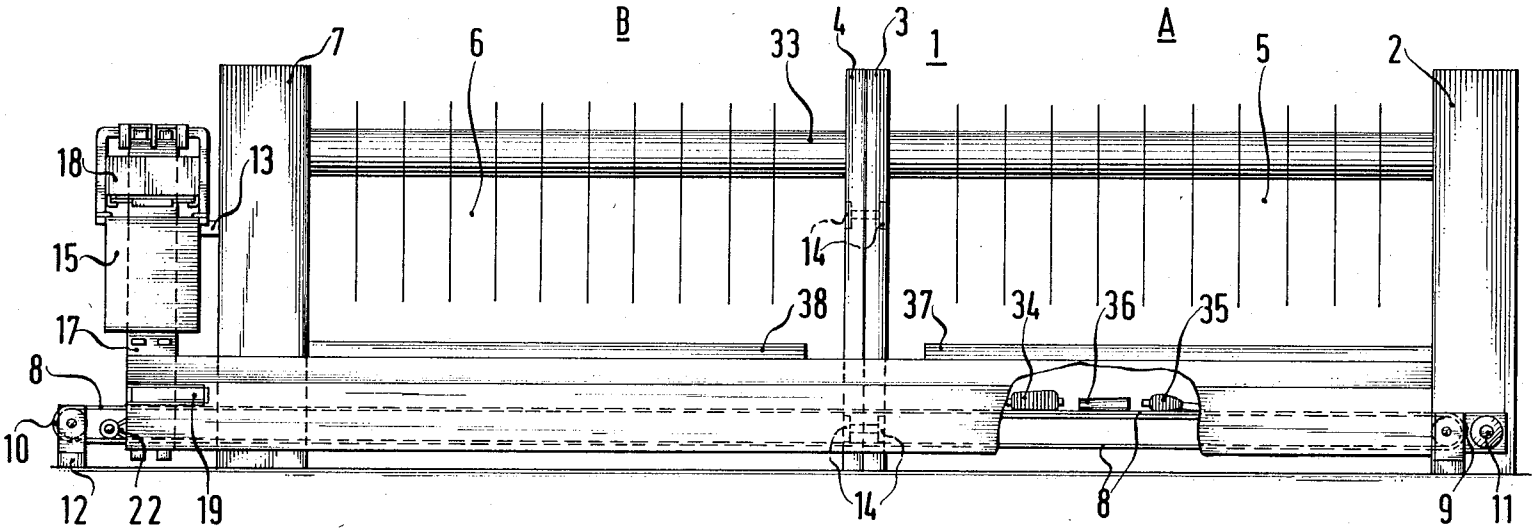
FIG. 1 is a diagrammatic front elevational view, partly broken away, of a spool winding machine, which winds only one batch of yarn.
Figure 2:
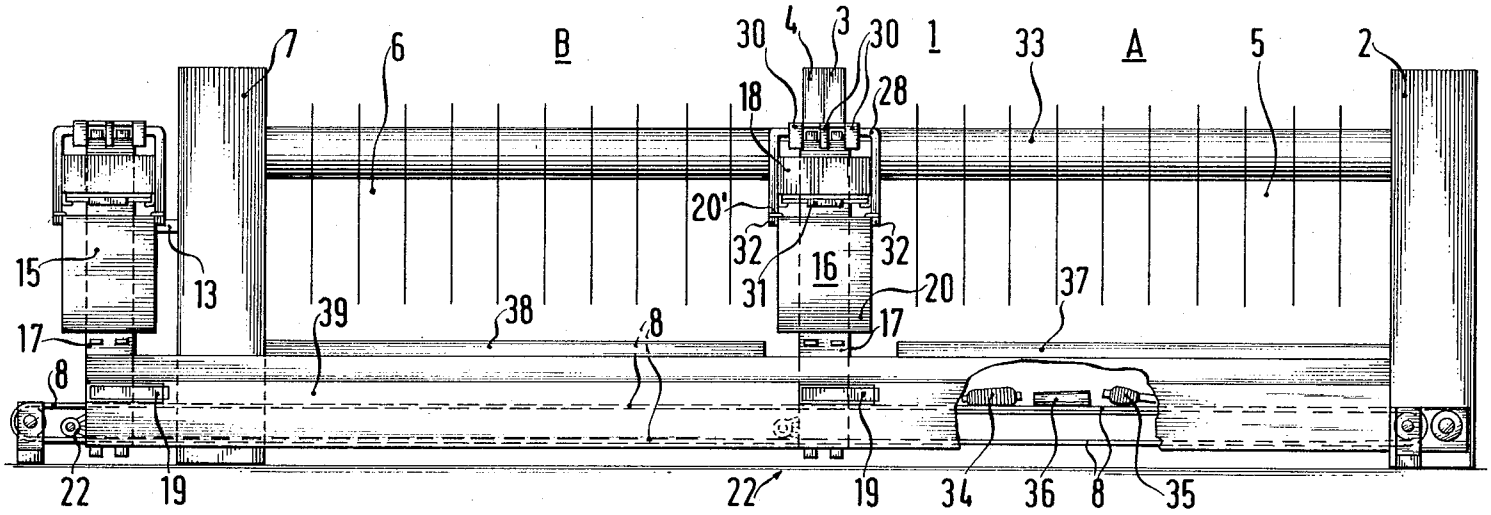
FIG. 2 is a view similar to FIG. 1 of the same spool winding machine equipped for two batches of yarn.

Referring now to the figures of the drawing in detail and first particularly to FIGS. 1 and 2 thereof, there is seen a spool winding machine which is designated as a whole with reference numeral 1, and includes two sections A and B. Section A contains a drive frame 2, an intermediate frame 3, and a number of work stations 5 disposed therebetween. Section B contains an end frame 7, an intermediate frame 4, and work stations 6 disposed therebetween. Horizontal conveying means 8 are disposed along the work stations 5, 6 near the floor. The horizontal conveying means 8 are constructed as an endless conveyor belt. The conveyor belt 8 is wrapped around a drive roller 9 and around a belt roller 10. The drive roller 9 is disposed in the drive frame 2 and is driven by a drive motor 11. The belt rotor 10 is supported in a bearing block 12 near the end frame 7.

Above the horizontal conveyor 8, are two mounting devices or positions 13 and 14 which are prepared for removal devices. In FIG. 1, one spool removal device 15 is shown. In FIG. 2, an additional spool removal device 16 is shown besides the spool removal device 15. The two spool removal devices are constructed identically.

FIGS. 3 to 6 show the details of the spool removal device 16, which also apply for the spool removal device 15. Each spool removal device is provided with a spool lifting device 17, a spool catching container 18, a spool diverting device 19, and an exchangeable spool collecting container 20.

The spool lifting device 17 is formed of an elevator which is provided with lifting cogs 21. Each individual spool lifting device can be driven off the horizontal conveyor 8 by a power transmitting unit 22.

The spool diverting device 19 is formed of deflection means which are disposed immediately above the conveyor belt 8. The power transmitting device 22 is provided with a friction wheel 23, a gear drive 24 and a drive element 25 in the form of a belt roller which is connected to the elevator 17.

FIG. 5 shows the disposition of the gear drive 24, the spool diverting device 19 and the drive element 25. This assembly is supported on two brackets 26, 27 which are fastened with screws at the lower part of the prepared position 14 on the intermediate frames 3 and 4. FIGS. 3 and 6 show that a bracket 28 which is bolted to the intermediate frames 3 and 4 at the upper part of the position 14, carries the spool catching container 18 and a second belt roller 29. The bracket 28 also supports a spool ejector or guard 30 in the form of a rake.

The spool catching or collecting container 18 is closed at the bottom thereof by a slider 31. As seen in FIG. 2, ledges 20' are disposed on the spool collecting container 20 which hangs on cross pieces 32 of the container 18 below the slider 31.

In this embodiment of the invention, the prepared position 14 for mounting is formed as depressed regions and pre-drilled holes in the intermediate frames 3 and 4 for receiving and securing the brackets 26 to 28. The prepared position 13 is formed of struts which are fastened to the side of the end frame 7, and also serve for mounting and holding the brackets 26 to 28.

In different mounting positions, the construction of the mountings may be different. The important object is to construct the mounting positions in such a manner that the assembly of the spool removal device is as simple as possible, and that efforts for alignment and adjustment are also avoided as much as possible, because alignment is automatically provided and assured by stops, holes and the like.

In this embodiment, the drive 24 is formed of a bevel gear drive. The drawings show that the individual work stations 5 and 6 of the sections A and B are fastened to a support or carrier tube 33.

FIGS. 1 to 5 show the wound spools 34 which were ejected from the automatic spool winding device 1, partially wound spools 35, as well as empty spools 36, which move into the transport or conveyor belt 8 over slides 37, 38. A guard 39 prevents the spools from falling forward.

According to FIG. 1, only one spool removal device 15 is provided at the end of the spool winding machine 1. The mounting position 14 for a second spool removal device remains unused. Only one batch of yarn is wound on the spool winding machine.

According to FIG. 2, the second available mounting position 14 is also occupied by a spool removal device 16. The spools of Section A are conducted by the spool diverting device 19 to the spool lifting device 17; the spools are elevated there according to FIG. 3; and the spools are ejected by the spool ejector 30 from the elevator compartments formed by the lifting cogs 21, so that the spools roll into the spool catching container 18. The spool catching container 18 is disposed at the working level, so that the useable wound, or partially wound, spools can be taken out at the working level. In case the spool winding machine is used as a rewinding device, the ejected wound, or partially wound, spools can again be loaded into the spool winding machine for rewinding after the thread end has been picked up. The empty spools 36 drop into the spool collecting container 20 when the slider or sliding door 31 is pulled out. It is possible to wind different batches of yarn in the sections A and B. The ejected spools are separately collected, and cannot be easily intermixed between the different individual batches.

The invention is especially suited for spool winding machines which are divided into sections. The mounting positions are most practically disposed at the intermediate frames, or at the separating points between the sections. However, it is also possible to locate the mounting positions at the borders of the individual working stations. In this case, the length of each section, or the number of working stations assigned to a certain batch, can be chosen freely. However, the basic construction of the entire collecting device is the same in all cases. The horizontal transporting device is always the same. The length of the transporting device only depends on the established length of the spool winding device. The number of spool removal devices only depends on the existing winding conditions.

The spool removal devices can deflect and remove the spools from the horizontal spool transporting device practically at any chosen location. A separate power source for driving the spool removal device is not required.

The invention is not limited to the variations of the embodiment used as an example. The fully or partially wound spools may be creel bobbins or winding bobbins.

I claim:

1. Device for collecting ejected wound, partially wound, or empty spools at the working stations of an automatic spool winding machine, comprising means guided along the working stations for horizontally transporting the spools; at least two laterally spaced apart mounting devices disposed in vicinity of said transporting means; at least one spool removal device mounted to one of said mounting devices and removable for mounting on another of said mounting devices, said spool removal device including a spool diverting device downstream of said transporting means for receiving the spools, a spool lifting device for lifting the spools from said diverting device, and a spool collecting container for receiving the spools from said lifting device and holding them in a fixed position; and means for transmitting motion of said transporting means to said spool lifting device for driving said spool lifting device.

2. Device according to claim 1, wherein said transporting means are in the form of an endless conveyor belt, and said spool diverting device includes a deflector disposed above said conveyor belt.

3. Device according to claim 1, wherein said spool lifting device is an elevator.

4. Device according to claim 2, wherein said spool lifting device is an elevator.

5. Device according to claim 3, wherein said force transmitting means includes a friction wheel engageable with said transporting means, a drive connected to said friction wheel, and a drive element connected to said drive and to said elevator.

6. Device according to claim 4, wherein said force transmitting means includes a friction wheel engageable with said transporting means, a drive connected to said friction wheel, and a drive element connected to said drive and to said elevator.

* * * * *